US011118609B2

(12) United States Patent
Nishimoto et al.

(10) Patent No.: US 11,118,609 B2
(45) Date of Patent: Sep. 14, 2021

(54) HYDRAULIC SYSTEM FOR WORKING MACHINE

(71) Applicant: KUBOTA CORPORATION, Osaka (JP)

(72) Inventors: Ryuki Nishimoto, Osaka (JP); Yuji Fukuda, Osaka (JP); Jun Tomita, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/432,042

(22) Filed: Jun. 5, 2019

(65) Prior Publication Data

US 2020/0048868 A1 Feb. 13, 2020

(30) Foreign Application Priority Data

Aug. 9, 2018 (JP) ..... JP2018-150738

(51) Int. Cl.
*F15B 11/042* (2006.01)
*F15B 13/043* (2006.01)

(52) U.S. Cl.
CPC ..... *F15B 13/043* (2013.01); *F15B 11/0426* (2013.01)

(58) Field of Classification Search
CPC .. F15B 13/043; F15B 11/0426; F15B 11/048; F15B 2211/67
See application file for complete search history.

(56) References Cited

U.S. PATENT DOCUMENTS 4,367,624 A * 1/1983 Ogata ..... E02F 3/844 60/484
9,505,288 B2 * 11/2016 Bauer ..... B60G 17/08
9,650,232 B2 * 5/2017 Sugano ..... F15B 11/024
2019/0257304 A1 * 8/2019 Kondo ..... E02F 9/2004

FOREIGN PATENT DOCUMENTS

JP 2009-293631 12/2009

* cited by examiner

*Primary Examiner* — F Daniel Lopez
(74) *Attorney, Agent, or Firm* — Greenblum & Bernstein, P.L.C.

(57) ABSTRACT

A hydraulic system includes a control device to reduce a first movement speed to be lower than a second movement speed, the first movement speed being a speed at which a spool of a first control valve moves from a first supply position to a first stop position under a state where a second control valve is in the second supply position, the second movement speed being a speed at which the spool moves from the first supply position to the first stop position under a state where the second control valve is in the second stop position. The first supply position allows operation fluid to be supplied to a hydraulic actuator. The first stop position prevents the operation fluid from being supplied to the hydraulic actuator. The second stop position prevents the operation fluid from being supplied to a first fluid tube coupling a hydraulic pump to the hydraulic actuator.

6 Claims, 6 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-150738, filed Aug. 9, 2018. The content of this application is incorporated herein by reference in their entirety.

BACKGROUND OF THE INVENTION

Field of the Invention

The present invention relates to a hydraulic system for a working machine and a hydraulic control method for the working machine such as a skid steer loader, a compact truck loader, and a backhoe, for example.

Description of Related Art

Japanese Unexamined Patent Application Publication No. 2009-293631 is previously known as a technique for increasing the flow rate of operation fluid to be supplied to a hydraulic actuator in a working machine. The hydraulic system for the working machine includes a main pump configured to supply the operation fluid to the hydraulic actuator, a sub pump configured to increase the flow rate of the operation fluid to be supplied to the hydraulic actuator, a control valve configured to control the flow rate of the operation fluid to be supplied from the main pump to the hydraulic actuator, an increment fluid tube configured to supply the operation fluid to the operation fluid flow tube supplying the operation fluid from the control valve to the hydraulic actuator, the operation fluid being outputted from the sub pump, and a high flow valve provided in the increment fluid tube and configured to control the flow rate of the operation fluid to be supplied to the operation fluid flow tube, the operation fluid being outputted from the sub pump.

SUMMARY OF THE INVENTION

A hydraulic system for a working machine according to one aspect of the present invention, includes a first hydraulic pump to output an operation fluid, the first hydraulic pump being constituted of a constant displacement pump, a second hydraulic pump to output the operation fluid, the second hydraulic pump being constituted of a constant displacement pump, a hydraulic actuator, a first fluid tube coupling the first hydraulic pump to the hydraulic actuator, and a first control valve including a spool, the spool having a first supply position allowing the operation fluid to be supplied to the hydraulic actuator, the operation fluid being outputted from the first hydraulic pump to the first fluid tube and a first stop position preventing the operation fluid from being supplied to the hydraulic actuator, the operation fluid being outputted to the first fluid tube. The spool is configured to be moved between the first supply position and the first stop position and thereby to change a flow rate of the operation fluid to be supplied to the first fluid tube. The hydraulic system includes a second fluid tube coupling the second hydraulic pump to the first fluid tube, a second control valve having a second supply position allowing the operation fluid to be supplied to the first fluid tube, the operation fluid being outputted from the second hydraulic pump to the second fluid tube, and a second stop position preventing the operation fluid from being supplied to the first fluid tube actuator, the operation fluid being outputted to the second fluid tube, the second control valve being configured to be switched between the second supply position and the second stop position, The hydraulic system further includes a control device to reduce a first movement speed to be lower than a second movement speed, the first movement speed being a speed at which the spool moves from the first supply position to the first stop position under a state where the second control valve is in the second supply position, the second movement speed being a speed at which the spool moves from the first supply position to the first stop position under a state where the second control valve is in the second stop position.

A hydraulic control method for a working machine according to one aspect of the present invention, configured to control a hydraulic system including a first hydraulic pump to output an operation fluid, the first hydraulic pump being constituted of a constant displacement pump, a second hydraulic pump to output the operation fluid, the second hydraulic pump being constituted of a constant displacement pump, a hydraulic actuator, a first fluid tube coupling the first hydraulic pump to the hydraulic actuator, a first control valve including a spool. The spool has a first supply position allowing the operation fluid to be supplied to the hydraulic actuator, the operation fluid being outputted from the first hydraulic pump to the first fluid tube, and a first stop position preventing the operation fluid from being supplied to the hydraulic actuator, the operation fluid being outputted to the first fluid tube, the spool being configured to be moved between the first supply position and the first stop position and thereby to change a flow rate of the operation fluid to be supplied to the first fluid tube. The hydraulic system includes a second fluid tube coupling the second hydraulic pump to the first fluid tube, a second control valve having a second supply position allowing the operation fluid to be supplied to the first fluid tube, the operation fluid being outputted from the second hydraulic pump to the second fluid tube, and a second stop position preventing the operation fluid from being supplied to the first fluid tube actuator, the operation fluid being outputted to the second fluid tube, the second control valve being configured to be switched between the second supply position and the second stop position; and a control device. The hydraulic control method includes steps of judging whether the second control valve is in the second supply position, judging whether a request to move the spool from the first supply position to the first stop position has been issued, and reducing a first movement speed to be lower than a second movement speed when control device determines that the second control valve is in the second supply position and that the request has been issued, the first movement speed being a speed at which the spool moves from the first supply position to the first stop position under a state where the second control valve is in the second supply position, the second movement speed being a speed at which the spool moves from the first supply position to the first stop position under a state where the second control valve is in the second stop position.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
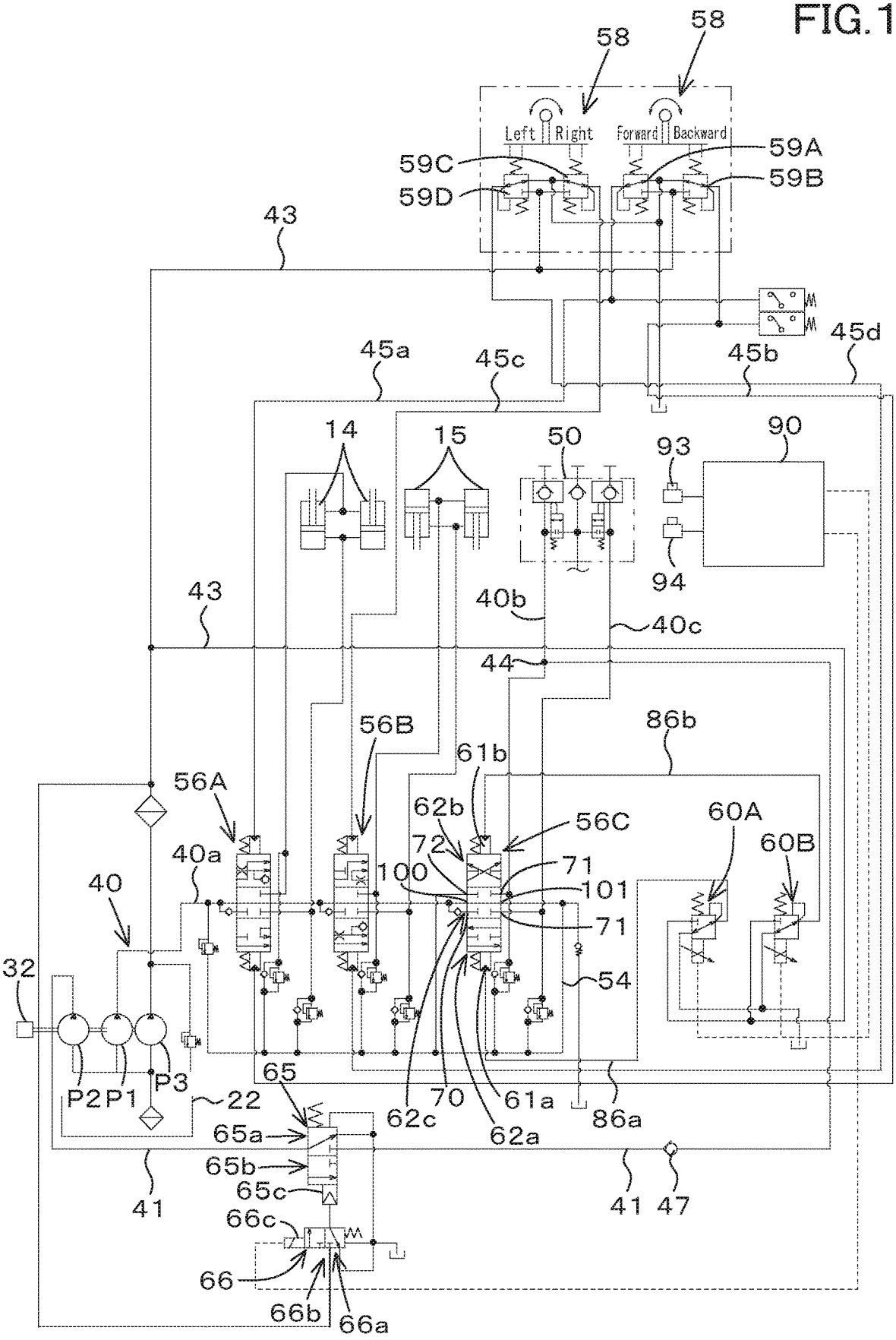
FIG. 1 is a schematic view of a hydraulic system for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

An embodiment of a hydraulic system for a working machine and the working machine having the hydraulic system according to the present invention will be described below with reference to the drawings.

Figure 5:
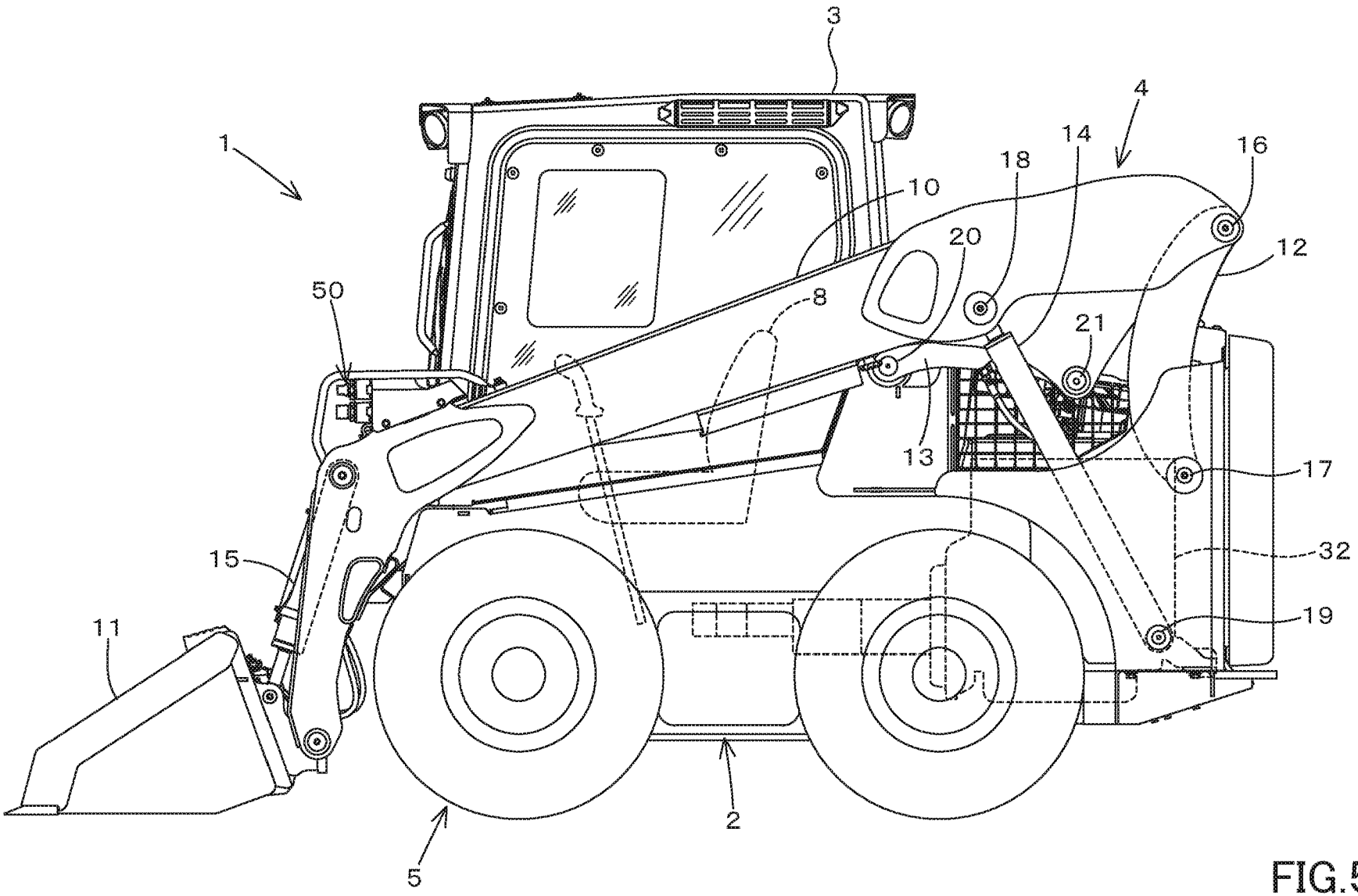
FIG. 5 is a side view illustrating a skid steer loader that is one example of the working machine according to the embodiment.

FIG. 5 shows a side view of a working machine according to an embodiment of the present invention. In FIG. 5, a skid steer loader is shown as an example of the working machine. However, the working machine according to the present invention is not limited to the skid steer loader, and may be, for example, another type of loader working machine such as a compact track loader. In addition, a working machine other than the loader working machine may be employed.

As shown in FIG. 5, the working machine 1 includes a machine body 2, a cabin 3, a working device 4, and a traveling device 5.

In the embodiment of the present invention, the front side (the left side in FIG. 5) of the operator seated on the operator seat 8 of the working machine 1 is referred to as the front, the rear side (the right side in FIG. 5) of the operator is referred to as the rear, the left side of the operator is referred to as the left, and the right side of the operator is referred to as the right.

Moreover in the explanation of the embodiment, the horizontal direction which is a direction orthogonal to the front-rear direction is referred to as a machine width direction. The direction extending from the central portion of the machine body 2 to the right portion or the left portion will be described as a machine outward direction.

In other words, the machine outward direction corresponds to the machine width direction and is the direction separating away from the machine body 2. A direction opposite to the machine outward direction will be described as a machine inward direction. In other words, the machine inward direction corresponds to the machine width direction and is the direction approaching the machine body 2.

The cabin 3 is mounted on the machine body 2. The cabin 3 is provided with an operator seat 8. The working device 4 is attached to the machine body 2. The traveling device 5 is provided on the outside of the machine body 2. A prime mover 32 is mounted at the rear portion of the machine body 2. The prime mover 32 is constituted of an electric motor, an engine, and the like. In the embodiment, the prime mover 32 is constituted of the engine.

The working device 4 includes a boom 10, a working tool 11, a lift link 12, a control link 13, a boom cylinder 14, and a bucket cylinder 15.

The boom 10 is provided on the right side of the cabin 3, and another boom 10 is provided on the left side of the cabin 3. The booms 10 is configured to be swung upward and downward. The working tool 11, for example, is a bucket, and the bucket 11 is provided at the tip end portions (the front end portions) of the booms 10 so as to be swung upward and downward. The lift link 12 and the control link 13 support the base portion (the rear portion) of each of the booms 10 so that the boom 10 can be swung upward and downward.

The boom cylinder 14 is stretched and shortened to move the boom 10 upward and downward. The bucket cylinder 15 is stretched and shortened to swing the bucket 11.

The front portions of the left boom 10 and the right boom 10 are coupled to each other by a deformed connecting pipe. The base portions (the rear portions) of the booms 10 are coupled to each other by a cylindrical connecting pipe.

A pair of the lift link 12, the control link 13 and the boom cylinder 14 is provided on the left side of the machine body 2 corresponding to the boom 10 arranged on the left side, and another pair of the lift link 12, the control link 13 and the boom cylinder 14 is provided on the right side of the machine body 2 corresponding to the boom 10 arranged on the right side.

The lift link 12 is provided vertically at the rear portion of the base portion of each of the booms 10. The upper portion (one end side) of the lift link 12 is supported rotatably about a lateral axis by a pivot shaft 16 (a first pivot shaft) near the rear portion of the base portion of each of the booms 10.

In addition, the lower portion (the other end side) of the lift link 12 is supported rotatably about the horizontal axis by a pivot shaft 17 (a second pivot shaft) near the rear portion of the machine body 2. The second pivot shaft 17 is provided below the first pivot shaft 16.

An upper portion of the boom cylinder 14 is supported rotatably about the lateral axis by a pivot shaft 18 (a third pivot Shaft). The third pivot shaft 18 is provided at the base portion of each of the booms 10 and particularly at the front portion of the base portion.

The lower portion of the boom cylinder 14 is supported rotatably about the lateral axis by a pivot shaft 19 (a fourth pivot shaft). The fourth pivot shaft 19 is provided near the lower portion of the rear portion of the machine body 2 and below the third pivot shaft 18.

The control link 13 is provided in front of the lift link 12. One end of the control link 13 is supported rotatably about the lateral axis by a pivot shaft 20 (a fifth pivot shaft). The fifth pivot shaft 20 is provided at a position corresponding to the front of the lift link 12 in the machine body 2.

The other end of the control link 13 is supported rotatably about the lateral axis by a pivot shaft 21 (a sixth pivot shaft). The sixth pivot shaft 21 is provided in front of the second pivot shaft 17 and above the second pivot shaft 17 in the boom 10.

When the boom cylinder 14 is stretched and shortened, each of the booms 10 is swung upward and downward around the first pivot shaft 16 while the base portion of each of the booms 10 is supported by the lift link 12 and the control link 13. In this manner, the tip end portion of each of the booms 10 moves upward and downward.

The control link 13 is swung upward and downward around the fifth pivot shaft 20 in accordance with the upward and downward swinging of each of the booms 10. The lift link 12 is swung backward and forward around the second pivot shaft 17 in accordance with the upward and downward swinging of the control link 13.

Instead of the bucket 11, another working tool can be attached to the front portion of the boom 10, Another working tool is, for example, an attachment (an auxiliary attachment) such as a hydraulic crusher, a hydraulic breaker, an angle broom, an earth auger, a pallet fork, a sweeper, a mower, a snow blower, or the like.

A connecting member 50 is provided at the front portion of the boom 10 arranged on the left side. The connecting member 50 is a member to which a tube member such as a pipe is connected, the tube member being connected to the auxiliary actuator attached to the auxiliary attachment.

Each of the bucket cylinders 15 is respectively arranged near the front portion of each of the booms 10. When the bucket cylinder 15 is stretched and shortened, the bucket 11 is swung.

In the present embodiment, wheel-type traveling devices 5A and 5B each having front wheels 5F and rear wheels 5R are adopted as the traveling device 5 arranged on the right and the traveling devices 5 arranged on the left. The traveling devices may employ crawler type traveling devices (including semi-crawler type traveling devices) for the traveling devices 5A and 5B.

As shown in FIG. 1, the hydraulic system for the working machine includes a first hydraulic pump P1, a second hydraulic pump P2, and a third hydraulic pump P3.

The first hydraulic pump P1, the second hydraulic pump P2, and the third hydraulic pump P3 are pumps to be driven by the power of the prime mover 32, and are constituted of the constant displacement gear pumps (also referred to as the fixed displacement gear pumps). The first hydraulic pump P1 is configured to output the operation fluid stored in the operation fluid tank 22.

The first hydraulic pump P1 outputs the operation fluid mainly used for operating a hydraulic actuator. A first fluid tube 40 is provided at an outlet port (an output port) for outputting the operation fluid in the first hydraulic pump P1.

The second hydraulic pump P2 is also a pump configured to output the operation fluid stored in the operation fluid tank 22 and to increase the operation fluid to the hydraulic actuator. A second fluid tube 41 is provided at an outlet port (an output port) for outputting the operation fluid in the second hydraulic pump P2.

The third hydraulic pump P3 is also configured to output the operation fluid stored in the operation fluid tank 22. A third fluid tube 43 is provided at an outlet port (an output port) for outputting the operation fluid in the third hydraulic pump P3.

In particular, the third hydraulic pump P3 outputs the operation fluid mainly used for control. For convenience of the explanation, the operation fluid outputted from the third hydraulic pump P3 is referred to as a pilot fluid, and the pressure of the pilot fluid is referred to as a pilot pressure.

A boom control valve 56A, a bucket control valve (a working tool control valve) 56B, and an auxiliary control valve 56C are arranged on the first fluid tube 40. The boom control valve 56A is a valve configured to control a hydraulic cylinder (a boom cylinder) 14 that controls the boom. The bucket control valve 56B is a valve configured to control a hydraulic cylinder (a bucket cylinder) 15 that controls the bucket.

The auxiliary control valve 56C is a valve for controlling an auxiliary actuator (a hydraulic cylinder, a hydraulic motor) mounted on an auxiliary attachment such as a hydraulic crusher, a hydraulic breaker, an angle broom, an earth auger, a pallet fork, a sweeper, a mower, a snow blower, or the like.

The boom control valve 56A and the bucket control valve 56B each are direct-acting spool three-position switching valves actuated by the pilot fluid. The boom control valve 56A and the bucket control valve 56B are configured to be switched by the pilot pressure between a neutral position, a first position different from the neutral position, and a second position different from the neutral position and the first position.

The boom cylinder 14 is coupled to the boom control valve 56A by a fluid tube, and the bucket cylinder 15 is coupled to the bucket control valve 56B by a fluid tube.

The boom 10 and the bucket 11 can be operated by an operation lever 58 arranged around the operator seat 8. The operating lever 58 is supported so as to be tilted from the neutral position in the front-rear direction (the longitudinal direction), the left-right direction (the lateral direction), and the diagonal directions (directions between the longitudinal direction and the lateral).

When the operating lever 58 is tilted, it is possible to operate a plurality of pilot valves (the operation valves) 59A, 59B, 59C, and 59D provided at the lower portion of the operating lever 58.

The pilot valves 59A, 59B, 59C, and 59D is coupled to the third hydraulic pump P3 by a third fluid tube 43.

The plurality of pilot valves (operation valves) 59A, 59B, 59C, and 59D are respectively coupled to the boom control valve 56A and the bucket control valve (the working tool control valve) 56B by a plurality of fluid tubes 45*a*, 45*b*, 45*c*, and 45*d*.

In particular, the pilot valve 59A is coupled to the boom control valve 56A by the fluid tube 45*a*. The pilot valve 59B is coupled to the boom control valve 56A by the fluid tube 45*b*.

The pilot valve 59C is coupled to the bucket control valve 56B by the fluid tube 45*c*. The pilot valve 59D is coupled to the bucket control valve 56B by the fluid tube 45*d*.

The pilot valves (operation valves) 59A, 59B, 59C, and 59D are respectively configured to determine an output pressure of the operation fluid to be outputted in accordance with the operation of the operation lever 58.

In particular, when the operation lever 58 is tilted forward, the pilot valve (operation valve) 59A for downward movement is operated to determine the pilot pressure of the pilot fluid to be outputted from the lowering pilot valve 59A for downward movement.

The pilot pressure is applied to the pressure receiving portion of the boom control valve 56A, then the boom cylinder 14 is shortened, and thereby the boom 10 is moved downward.

When the operation lever 58 is tilted backward, the pilot valve (operation valve) 59B for upward movement is operated to determine the pilot pressure of the pilot fluid to be outputted from the pilot valve 59B for upward movement.

The pilot pressure is applied to the pressure receiving portion of the boom control valve 56A, then the boom cylinder 14 is stretched, and thereby the boom 10 is moved upward.

When the operation lever 58 is tilted rightward, the pilot valve (operation valve) 59C for bucket dumping movement is operated to determine the pilot pressure of the pilot fluid to be outputted from the pilot valve 59C.

The pilot pressure is applied to the pressure receiving portion of the boom control valve 56B, then the bucket cylinder 15 is stretched, and thereby the bucket 11 performs the dumping operation.

When the operation lever 58 is tilted leftward, the pilot valve (operation valve) 59D for bucket shoveling movement is operated to determine the pilot pressure of the pilot fluid to be outputted from the pilot valve 59D.

The pilot pressure is applied to the pressure receiving portion of the boom control valve 56B, then the bucket cylinder 15 is shortened, and thereby the bucket 11 performs the shoveling operation.

The hydraulic system for the working machine is provided with a first control valve configured to control the flow rate of the operation fluid to be supplied from the first fluid tube 40 to the hydraulic actuator.

In the embodiment, the first control valve is an auxiliary control valve 56C, and the hydraulic actuator is an auxiliary actuator. Hereinafter, the description will be made assuming that the first control valve is the auxiliary control valve 56C.

The first fluid tube 40 includes a first section 40*a* coupling the first hydraulic pump P1 to the auxiliary control valve 56C, and at least two second sections 40*b* and 40*c* connected to the auxiliary control valve 56C.

The auxiliary control valve 56C includes an input port (a first input port) 70, an input port (a second input port) 100, an output port 71, a tank port (a first tank port) 72, and a tank port (a second tank port) 101.

The input port 70 is a port to Which the first section 40*a* of the first fluid tube 40 is connected and to which the operation fluid outputted from the first hydraulic pump P1 is supplied. Similarly to the input port 70, the input port 100 is a port to which the first section 40*a* of the first fluid tube 40 is connected and to which the operation fluid outputted from the first hydraulic pump P1 is supplied, and the input port 100 is different from the input port 70.

The output port 71 is a port to which the second sections 40*b* and 40*c* of the first fluid tube 40 are connected, and the output port 71 is configured to supply the operation fluid to the auxiliary actuator. The tank port 72 is a port for discharging the operation fluid, and is a port for discharging the operation fluid that has returned from the auxiliary actuator to the auxiliary control valve 56C.

A discharge fluid tube 54 is connected to the tank port 72*b*. The discharge fluid tube 54 is connected to the operation fluid tank 22, and is configured to discharge, to the operation fluid tank 22, the operation fluid that is discharged at least from the tank port 72 of the auxiliary control valve 56C.

The tank port 101 is a port for discharging the operation fluid, and is a port for discharging at least a part of the operation fluid introduced from the input port 100 to the auxiliary control valve 56C. The tank port 101 is connected to the discharge fluid tube 54.

In addition, the auxiliary control valve 56C is a switching valve having a spool, and is, for example, a direct-acting spool three-position switching valve configured to be activated by the pilot fluid. The spool of the auxiliary control valve 56C has a first supply positions 62*a* and 63*b* and a first stop position (a neutral position) 62*c* and is configured to be switched between the first supply positions 62*a* and 63*b* and the first stop position 62*c*. The first supply positions 62*a* and 62*b* allow the operation fluid to be supplied to the auxiliary actuator. The first stop position 62*c* stops supplying the operation fluid to the auxiliary actuator.

The spool of the auxiliary control valve 56C is moved to either one of the first supply positions 62*a* and 62*b*, and thereby the moving of the spool changes the flow rate of the operation fluid to be outputted from the output port 71 of the first fluid tube 40 of the auxiliary control valve 56C.

Pilot fluid tubes 86*a* and 86*b* are respectively connected to the pressure receiving portions 61*a* and 61*b* of the auxiliary control valve 56C. Proportional valves (a first proportional valve 60A and a second proportional valve 60B) are respectively connected to the pilot fluid tubes 86*a* and 86*b*.

The proportional valves (the first proportional valve 60A and the second proportional valve 60B) are electromagnetic valves configured to be magnetized to change the pilot pressure applied to the pressure receiving portions 61*a* and 61*b* of the auxiliary control valve 56C. The third fluid tube 43 is connected to the first proportional valve 60A and the second proportional valve 60B. The pilot fluid is supplied from the third hydraulic pump P3 to the first proportional valve 60A and the second proportional valve 60B.

The first proportional valve 60A and the second proportional valve 60B change the pilot pressure applied to the pressure receiving portions 61*a* and 61*b* of the auxiliary control valve 56C. In this manner, the spool of the auxiliary control valve 56C is moved in an arbitrary direction.

For example, when the first proportional valve 60A is opened, the pilot fluid is applied to the pressure receiving portion 61*a* of the auxiliary control valve 56C through the pilot fluid tube 86*a*, and then the pilot pressure to be applied to (given to) the pressure receiving portion 61*a* is determined depending on the opening aperture of the first proportional valve 60A.

When the pilot pressure applied to the pressure receiving portion 61*a* reaches a pressure equal to or higher than a predetermined pressure, the spool of the auxiliary control valve 56C moves from the first stop position 62*c* to the first supply position 62*a* side.

In addition, when the second proportional valve 60B is opened, the pilot fluid is applied to the pressure receiving portion 61*b* of the auxiliary control valve 56C through the pilot fluid tube 86*b*, and then the pilot pressure to be applied to (given to) the pressure receiving portion 61*b* is determined depending on the opening aperture of the second proportional valve 60B.

When the pilot pressure applied to the pressure receiving portion 61*b* reaches a pressure equal to or higher than a predetermined pressure, the spool of the auxiliary control valve 56C moves from the first stop position 62*c* to the first supply position 62*b* side.

The control device 90 controls magnetization and the like of the proportional valves 60 (the first proportional valve 60A and the second proportional valve 60B). The control device 90 is constituted of a CPU and the like. An operation member 93 is connected to the control device 90. An operation extent (for example, a slide amount, a swing amount, and the like) of the operation member 93 is inputted to the control device 90.

The operation member 93 is constituted of, for example, a seesaw switch configured to be swung, a slide switch configured to be slid, or a push switch configured to be pushed. When the operation member 93 is operated in one direction, an operation extent (a first operation extent) in one direction is inputted to the control device 90, and then the control device 90 changes the opening aperture of the first proportional valve 60A in accordance with the first operation extent.

Meanwhile, when the first operation extent is the maximum, the opening aperture of the first proportional valve 60A is the maximum. And, when the first operation extent is the minimum, the opening aperture of the first proportional valve 60A is the minimum. That is, the first operation extent and the opening aperture of the first proportional valve 60A are in a substantially proportional relationship each other.

In addition, when the operation member 93 is operated in the other direction, the operation extent (a second operation extent) in the other direction is inputted to the control device 90, and then the control device 90 changes the opening aperture of the second proportional valve 60B in accordance with the second operation extent.

When the second operation extent is the maximum, the opening aperture of the second proportional valve 60B is the maximum, And, when the second operation extent is the minimum, the opening aperture of the second proportional valve 60B is the minimum. That is, the second operation extent and the opening aperture of the second proportional valve 60B are in a substantially proportional relationship each other.

As described above, according to the hydraulic system for the working machine, the spool of the auxiliary control valve 56C is moved by the operation of the proportional valves 60 (the first proportional valve 60A and the second proportional valve 60B), and thereby the flow rate of the operation fluid to be supplied to the auxiliary actuator is changed.

Now, in the hydraulic system for the working machine, the operation fluid to be supplied to the auxiliary actuator can be increased. That is, the operation fluid outputted from the first hydraulic pump P1 and the operation fluid outputted from the second hydraulic pump P2 can be supplied together to the auxiliary actuator.

The hydraulic system for the working machine includes a second control valve (a high flow valve) 65 and a switching valve (a high flow switching valve) 66. The high flow valve 65 is arranged in the middle portion of the second fluid tube 41 that couples the first hydraulic pump P1 to the first fluid tube. The high flow valve 65 is a valve configured to determine the flow rate of the operation fluid flowing in the second fluid tube 41.

The end portion of the second fluid tube 41 is connected to the second section 40*b* of the first fluid tube 40. In addition, a check valve 47 is provided in a section between the high flow valve 65 and the coupling portion (a coupling portion between the first fluid tube 40 and the second fluid tube 41) 44. The check valve 47 is configured to allow the operation fluid to flow toward the coupling portion 44 and to prevent the operation fluid from flowing toward the high flow valve 65.

The high flow valve 65 is constituted of a two-position switching valve configured to be operated by the pilot pressure. The high flow valve 65 is configured to be switched between two switching positions (a second stop position 65*a* and a second supply position 65*b*) by the pilot pressure.

The high flow valve 65 is closed at the second stop position 65*a*, and thereby the flow rate of the operation fluid flowing in the second fluid tube 41 is made zero. In addition, the high flow valve 65 is opened at the second supply position 65*b*, and thereby the flow rate of the operation fluid flowing to the second fluid tube 41 is increased at a predetermined flow rate from zero.

In other words, the high flow valve 65 shuts off the second fluid tube 41 in the second stop position 65*a*, and opens the second fluid tube 41 so as to be communicated in the second supply position 65*b*.

The high flow switching valve 66 is a valve configured to operate the high flow valve 65 through the switching, and is constituted of an electromagnetic two-position switching valve. The high flow switching valve 66 is configured to be switched between a first position 66*a* and a second position 66*b*.

The high flow switching valve 66 is connected to the third fluid tube 43. When the high flow switching valve 66 is in the first position 66*a*, the pilot pressure is not applied to the pressure receiving portion 65*c* of the high flow valve 65, and thereby the high flow valve 65 is set to the first position 66*a*.

When the high flow switching valve 66 is in the second position 66*b*, the pilot pressure is applied to the solenoid 66*c* of the high flow valve 65, and thereby the high flow valve 65 is set to the second supply position 65*b*.

The controller 90 conducts the switching between the first position 66*a* and the second position 66*b* of the high flow switching valve 66. An operation member 94 such as a switch configured to be turned on/off is connected to the control device 90. The operation member 94 is constituted of, for example, a seesaw switch configured to be swung, a push switch configured to be pushed, or the like.

When the operation member 94 is turned off, that is, when the increase mode is turned off, the controller 90 demagnetizes the solenoid 66*c* of the high flow switching valve 66.

When the operation member 94 is turned on, that is, when the increase mode is turned on, the controller 90 continuously magnetizes the solenoid 66*c* of the high flow switching valve 66. When the solenoid 66*c* of the high flow switching valve 66 is magnetized, the high flow switching valve 66 is switched to the second position 66*b*, and the pilot pressure is applied to the pressure receiving portion of the high flow valve 65. In this manner, the high flow valve 65 is set to the second supply position 65*b*.

As the result, the operation fluid outputted from the second hydraulic pump P2 flows through the high flow valve 65, and then the operation fluid flows to the coupling portion 44 which is the end portion of the second fluid tube 41. Then, the operation fluid flowing from the second fluid tube 41 is confluent with the operation fluid flowing through the second section 40*b* of the first fluid tube 40 at the coupling portion 44, whereby the operation fluid flowing to the auxiliary actuator increases.

On the other hand, when the high flow switching valve 66 is set to the first position 66*a* to stop applying the pilot pressure to the pressure receiving portion of the high flow valve 65, the high flow valve 65 is set to the second stop position 65*a*. As the result, the operation fluid outputted from the second hydraulic pump P2 is blocked by the high flow valve 65, and the operation fluid which cannot pass through the high flow valve 65 returns to the operation fluid tank 22.

As the result, the operation fluid (the operation fluid of the second fluid tube 41) outputted from the second hydraulic pump P2 is not supplied to the second section 40*b* of the first fluid tube 40.

Then, the control device 90 changes the switching speed of the auxiliary control valve 56C, that is, the movement speed of the spool in the auxiliary control valve 56C in the case of the increase mode from not in the case of the increase mode.

Figure 2:
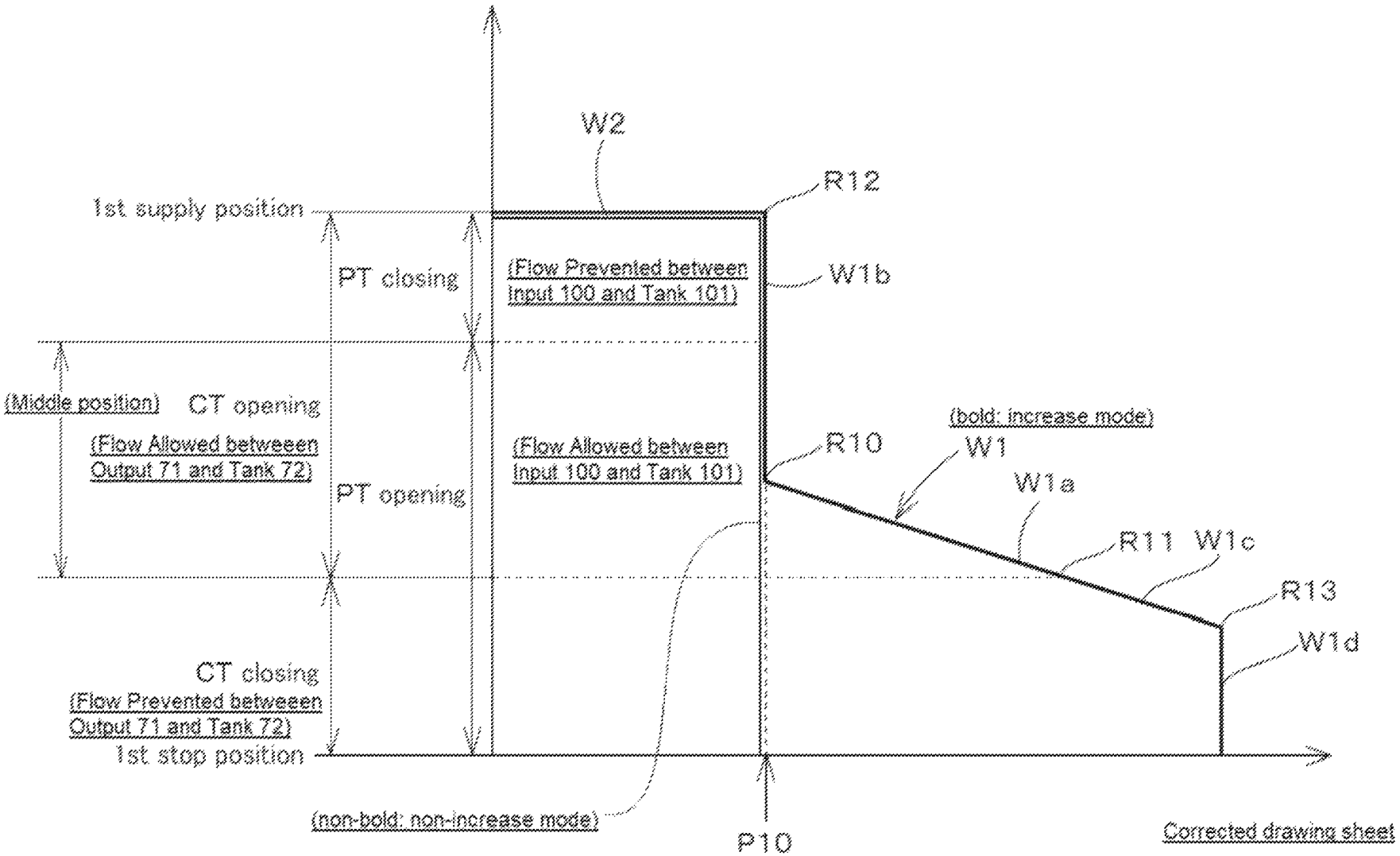
FIG. 2 is a view illustrating a movement transition of a spool according to the embodiment.

FIG. 2 shows a relation between a movement transition W1 of the spool of the auxiliary control valve 56C of the case where the high flow valve 65 is in the second supply position 65*b* (in the increase mode) and a movement transition W2 of the spool of the auxiliary control valve 56C of the case where the high flow valve 65 is in the second stop position 65*a* (not in the increase mode).

Prior to a time point P10 in FIG. 2, the spool of the auxiliary control valve 56C is moved to either one of the first supply positions 62*a* and 62*b* by operating the operation member 93 to the maximum operation extent, for example.

When the operation extent of the operation member 93 is reduced from the maximum to zero (when the operation of the operation member 93 is stopped) at the time point P10 in FIG. 2, the control device 90 rapidly reduces, to zero, the electric currents (the electric currents for magnetization) outputted to the first proportional valve 60A and the second proportional valve 60B. In this manner, the spool of the auxiliary control valve 56C is moved in one motion from either one of the first supply positions 62*a* and 62*b* to the second stop position 62*c* as shown in the movement transition W2.

On the other hand, the control device 90 gradually reduces, to zero, the electric currents (the electric currents for magnetization) outputted to the first proportional valve 60A and the second proportional valve 60B at the time point P10 in the increase mode. In this manner, the spool of the auxiliary control valve 56C is gradually moved from either one of the first supply positions 62*a* and 62*b* to the second stop position 62*c* as shown in the movement transition W1.

That is, assuming that a movement speed of the spool of the auxiliary control valve 56C from the first supply positions 62*a* and 62*b* to the first stop position 62*c* in the increase mode is referred to as a first movement speed V1 and that a movement speed of the spool of the auxiliary control valve 56C from the first supply positions 62*a* and 62*b* to the first stop position 62*c* not in the increase mode is referred to as a second movement speed V2, the first movement speed V1 is lower than the second movement speed V2.

In particular, in the auxiliary control valve 56C, the state in which the input port 100 and the tank port 101 are closed is referred to as a PT closing state (simply referred to as PT closing), and the state in which the input port 100 and the tank port 101 are communicated with each other is referred to as a PT opening state (simply referred to as PT closing). And, a state in which the output port 71 and the tank port 72 are communicated with each other is referred to as a CT opening state (simply referred to as a CT opening), and a state in which the output port 71 and the tank port 72 are closed is referred to as a CT closing state (simply referred to as a CT closing).

In that case, in the case where the spool of the auxiliary control valve 56C is in the first supply position 62*a* or in the first supply position 62*b*, the PT closing and the CT opening are established. And, in the case where the spool of the auxiliary control valve 56C is in the first stop position 62*c*, the PT opening and the CT closing are established.

Meanwhile, when the spool of the auxiliary control valve 56C is moved from the first supply positions 62*a* and 62*b* to the first stop position 62*c*, the PT closing is replaced by the PT opening at a predetermined position, and the CT opening is replaced by the CT closing at the predetermined position.

In the case of the increase mode, the controller 90 adjusts the electric current outputted to the first proportional valve 60A and the second proportional valve 60B at the time point P10, and thereby the first speed transition W1*a* from the position R10 for the PT opening and the CT opening to the position R11 for the PT opening and the CT closing is set to be slower than the second speed transition W1*b* from the position R12 for the PT closing to the position R10 for the PT opening and the CI opening.

That is, the spool of the auxiliary control valve 56C moves in one motion from the PT closing and the CT opening to the PT opening and the CT opening at the time point P10, and then gradually moves from the PT opening and the CT opening to the PT opening and the CT closing. That is, the slope of the first speed transition W1*a* is made gentler than the slope of the second speed transition W1*b*.

Meanwhile, as shown in FIG. 2, even after the spool is positioned at the position R11 where the PT opening and the CT closing are established, a speed transition (a third speed transition) W1*c* after the position R11 is also may be made slower than the second speed transition W1*b*. For example, after the third speed transition W1*c* from the position. R11*f* to the position (a predetermined position) R13 is made slower than the second speed transition W1*b*, the fourth speed transition. W1*d* from the predetermined position R13 to PT opening and CT closing (first stop position) is made the same as the second speed transition W1*b*.

Figure 3:
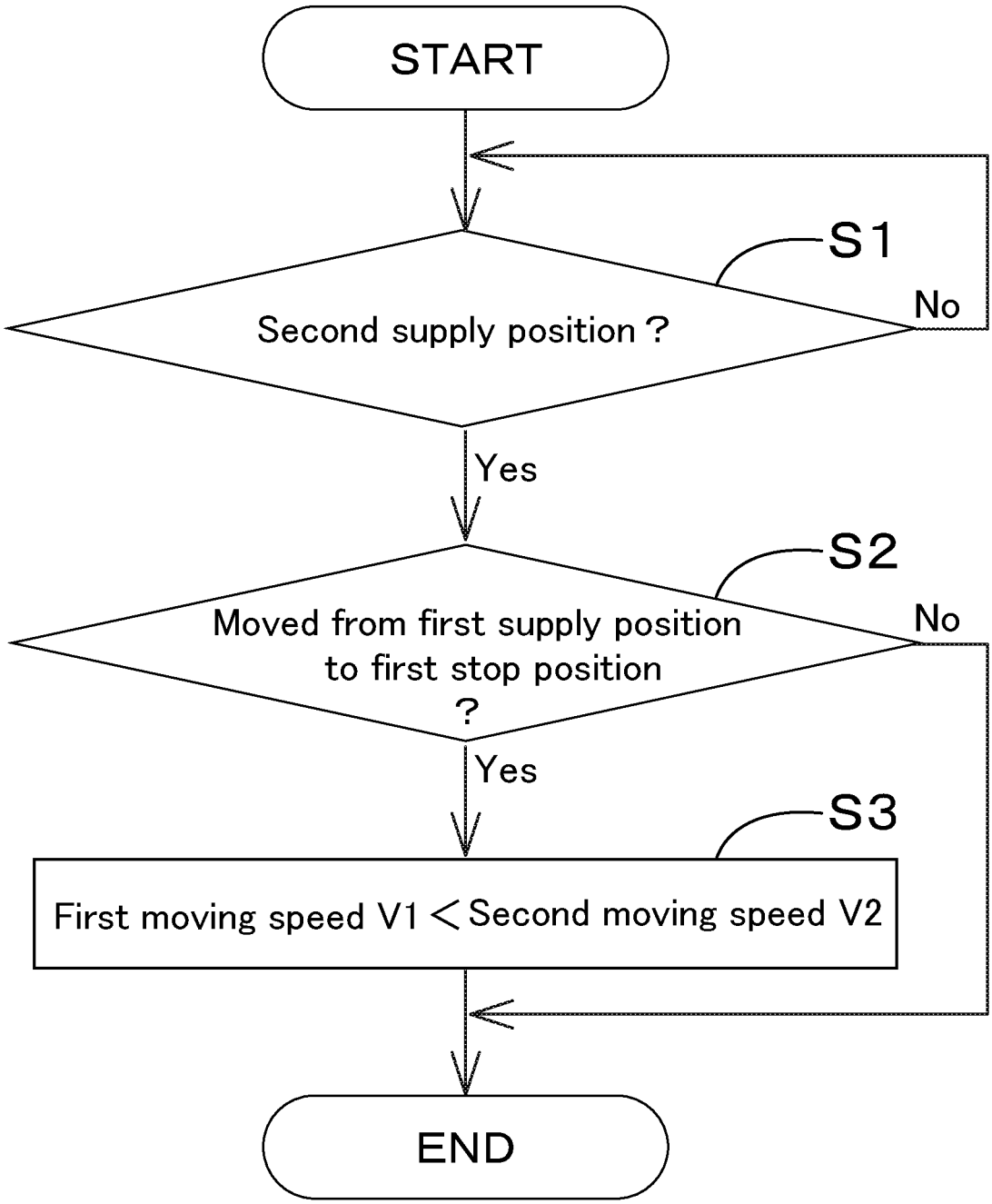
FIG. 3 is a view illustrating movement of a control device and the like (a hydraulic control method for the working machine) according to the embodiment.

FIG. 3 is a view showing the operation of the control device 90 and the like.

As shown in FIG. 3, in the state where the operation member 93 is operated in one direction or in the other direction and thereby the auxiliary actuator is in operation, the control device 90 judges whether the high flow valve 65 is at the second supply position 65*b*, that is, whether the increase mode is established (Step S1).

In addition, the control device 90 judges whether there is a request for moving the spool of the auxiliary control valve 56C from the first supply positions 62*a* and 62*b* to the first stop position 62*c*, that is, whether the operation member 93 is returned to the neutral position from the state where the operation member 93 is moved in either one of one direction and the other direction (Step S2).

In the control device 90, when the high flow valve 65 is in the second supply position 65*b* (Step S1, Yes) and there is a request to move the spool from the first supply positions 62*a* and 62*b* to the first stop position 62*c* (Step S2, Yes), the first movement speed V1 of the spool of the auxiliary control valve 56C is made slower than the second movement speed V2 (Step S3: a movement process).

For example, in the movement process, the controller 90 adjusts the electric current to be outputted to the proportional valve, and thereby sets the movement transition of the spool of the auxiliary control valve 56C to the movement transition W1 shown in FIG. 2.

In the case where the high flow valve 65 is in the second stop position 65*a* (Step S1, No) and a request to move the spool from the first supply positions 62*a* and 62*b* to the first stop position 62*c* is issued (Step S2, Yes), the control device 90 quickly move the spool of the auxiliary control valve 56C from the first supply positions 62*a* and 62*b* to the first stop position 62*c* as shown in the movement transition W2 in FIG. 2.

The hydraulic system for the working machine includes the first hydraulic pump P1 constituted of a constant displacement pump (also referred to as a fixed displacement pump) configured to output the operation fluid, the second hydraulic pump P2 constituted of a constant displacement pump configured to output the operation fluid, the hydraulic actuator, and the first fluid tube 40 coupling the first hydraulic pump P1 to the hydraulic actuator.

The hydraulic system includes the first control valve (the auxiliary control valve 56C) that has the spool having the first supply positions 62*a* and 62*b* allowing the operation fluid to be supplied to the hydraulic actuator, the operation fluid being outputted from the first hydraulic pump P1 to the first fluid tube 40, and the first stop position 62*c* preventing the operation fluid from being supplied to the hydraulic actuator, the operation fluid being outputted to the first fluid tube 40, and configured to move the spool to change the flow rate of the operation fluid to be supplied to the first fluid tube 40. The hydraulic system includes the second fluid tube 41 coupling the second hydraulic pump P2 to the first fluid tube 40, and the second control valve (the high flow valve 65) having the second supply position 65*b* allowing the operation fluid to be supplied to the first fluid tube 40, the operation fluid being outputted from the second hydraulic pump P2 to the second fluid tube 41, and the second stop position 65*a* preventing the operation fluid of the second fluid tube 41 from being supplied to the first fluid tube 40, the operation fluid being outputted to the second fluid tube 41, the second control valve being configured to be switched between the second supply position 65*b* and the second stop position 65*a*.

The hydraulic system includes the control device 90 to reduce the first movement speed V1 to be lower than the second movement speed V2, the first movement speed V1 being a speed at which the spool moves from the first supply positions 62*a* and 62*b* to the first stop position 62*c* under the state where the second control valve is in the second supply position 65*b*, the second movement speed V2 being a speed at which the spool moves from the first supply positions 62*a* and 62*b* to the first stop position 62*c* under the state where the second control valve is in the second stop position 65*a*.

According to that configuration, in the case where the second control valve is in the second supply position 65*b*, that is, in the increase mode, the shock generated by the switching of the first control valve (the auxiliary control valve 56C) can be reduced even when the hydraulic actuator is stopped by the first control valve (the auxiliary control valve 56C) from being operated (even when the first control valve is switched to the stop position).

The hydraulic system for the working machine includes the pilot fluid tubes 86*a* and 86*b* in which the operation fluid serving as the pilot fluid flows, and the proportional valves (the first proportional valve 60A and the second proportional valve 60B) connected to the pilot fluid tubes 86*a* and 86*b*. The first control valve has the pressure-receiving portions 61*a* and 61*b* configured to receive the pilot fluids flowing in the pilot fluid tubes 86*a* and 86*b*. The spool can be moved between the first supply positions 62*a* and 62*b* and the first stop position 62*c* by the pilot fluid supplied to the pressure-receiving portions 61*a* and 61*b*. The control device 90 changes the opening aperture of the proportional valve to reduce the first movement speed V1 to be lower than the second movement speed V2.

According to that configuration, it is possible to change the opening apertures of the proportional valves (the first proportional valve 60A and the second proportional valve 60B), and thereby easily making the first movement speed V1 of the spool lower than the second movement speed V2.

The first control valve includes the input ports 70 and 100 to which the operation fluid outputted from the first hydraulic pump P1 is supplied, the input ports 70 and 100 being connected to the first fluid tube 40, the output port 71 to supply the operation fluid to the hydraulic actuator, the output port 71 being connected to the first fluid tube 40, and the tank ports 72 and 101 to output the operation fluid. The spool close or open the input ports 70 and 100, the output port 71 and the tank ports 72 and 101 in the movement from the first supply positions 62*a* and 62*b* to the first stop position 62*c*.

The state closing the input port 100 and the tank port 101 is referred to as the PT closing, the state communicating the input port 100 with the tank port 101 is referred to as the PT opening, the state communicating the output port 72 with the tank port 72 is referred to as the CT opening, and the state closing the output port 72 and the tank port 72 is referred to as the CT closing. In that case, the control device 90 slow the first speed transition W1*a* of the spool moving from a position for the PT opening and the CT opening to another position for the PT opening and the CT closing in comparison with the second speed transition W1*b* of the spool moving from a position for the PT closing to another position for the PT opening and the CT opening.

According to that configuration, while the flow rate of the operation fluid supplied from the first control valve is reduced in a short time by the first speed transition W1*a*, the shock generated by the reduction of the operation fluid can be reduced by the second speed transition W1*b*.

A hydraulic control method for the working machine for controlling the hydraulic system includes the control device 90, and the hydraulic control method includes steps in which the control device 90 judges whether the second control valve is in the second supply position 65*b*, the control device 90 judges whether a request to move the spool from the first supply positions 62*a* and 62*b* to the first stop position 62*c* has been issued, and the control device 90 reduces the first movement speed V1 to be lower than the second movement speed V2 when the control device 90 determines that the second control valve is in the second supply position 65*b* and that the request has been issued.

According to that configuration, in the case where the second control valve is in the second supply position 65*b*, that is, in the increase mode, the shock generated by the switching of the first control valve (the auxiliary control valve 56C) can be reduced even when the hydraulic actuator is stopped by the first control valve (the auxiliary control valve 56C) from being operated (even when the first control valve is switched to the stop position).

In the embodiment described above, the second fluid tube 41 for increasing the operation fluid is connected to the second section 40*b* of the first fluid tube 40. However, as shown in FIG. 4A, the second fluid tube 41 may be connected to the first section 40*a* of the first fluid tube 40.

Figure 4A:
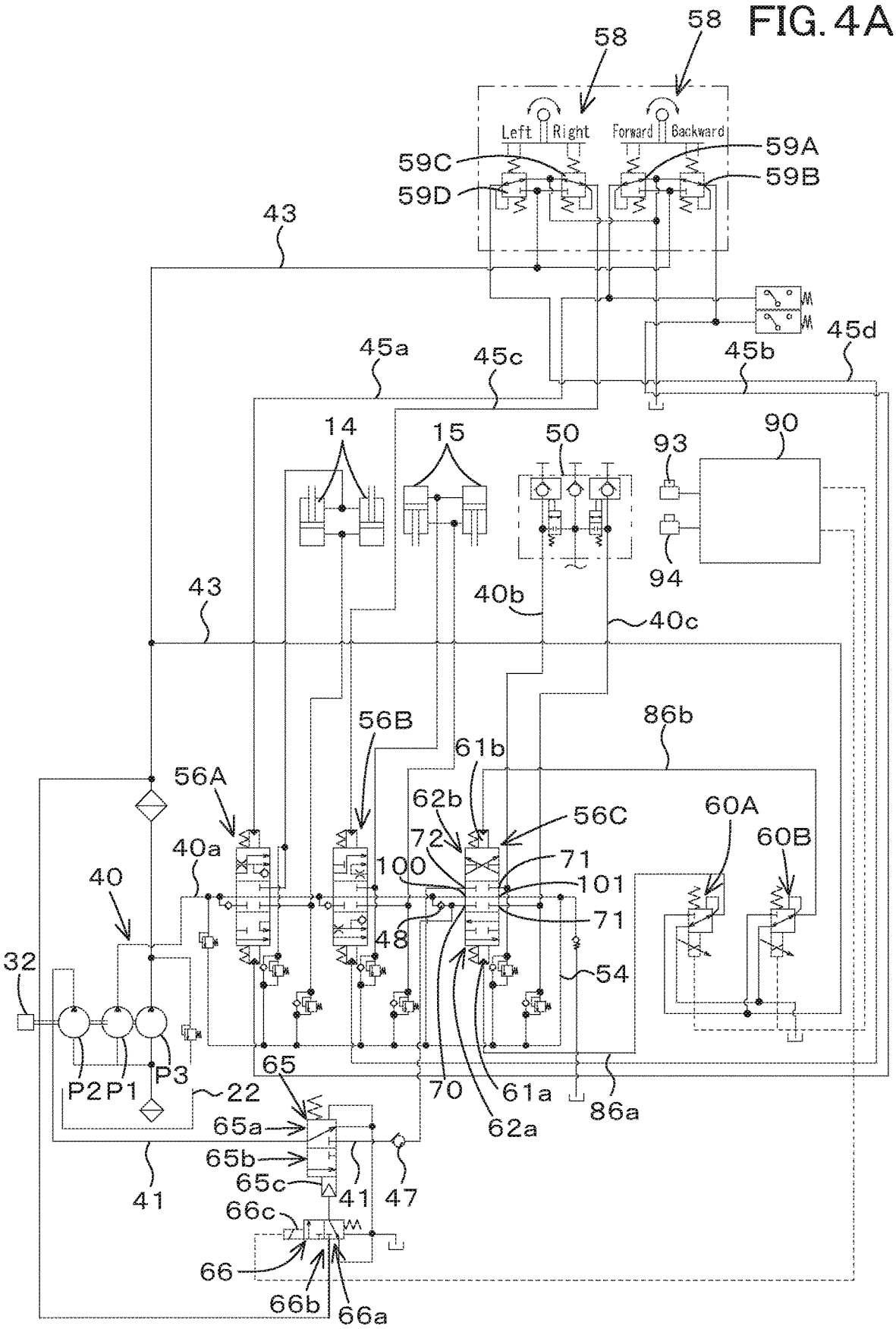
FIG. 4A is a modified example of the hydraulic system for the working machine according to the embodiment.

In particular, as shown in FIG. 4A, the end portion of the second fluid tube 41 is connected between the check valve 48 and the input port 70 in the first fluid tube 40. Also in that case, the second fluid tube 41 is provided with the check valve 47.

Figure 4B:
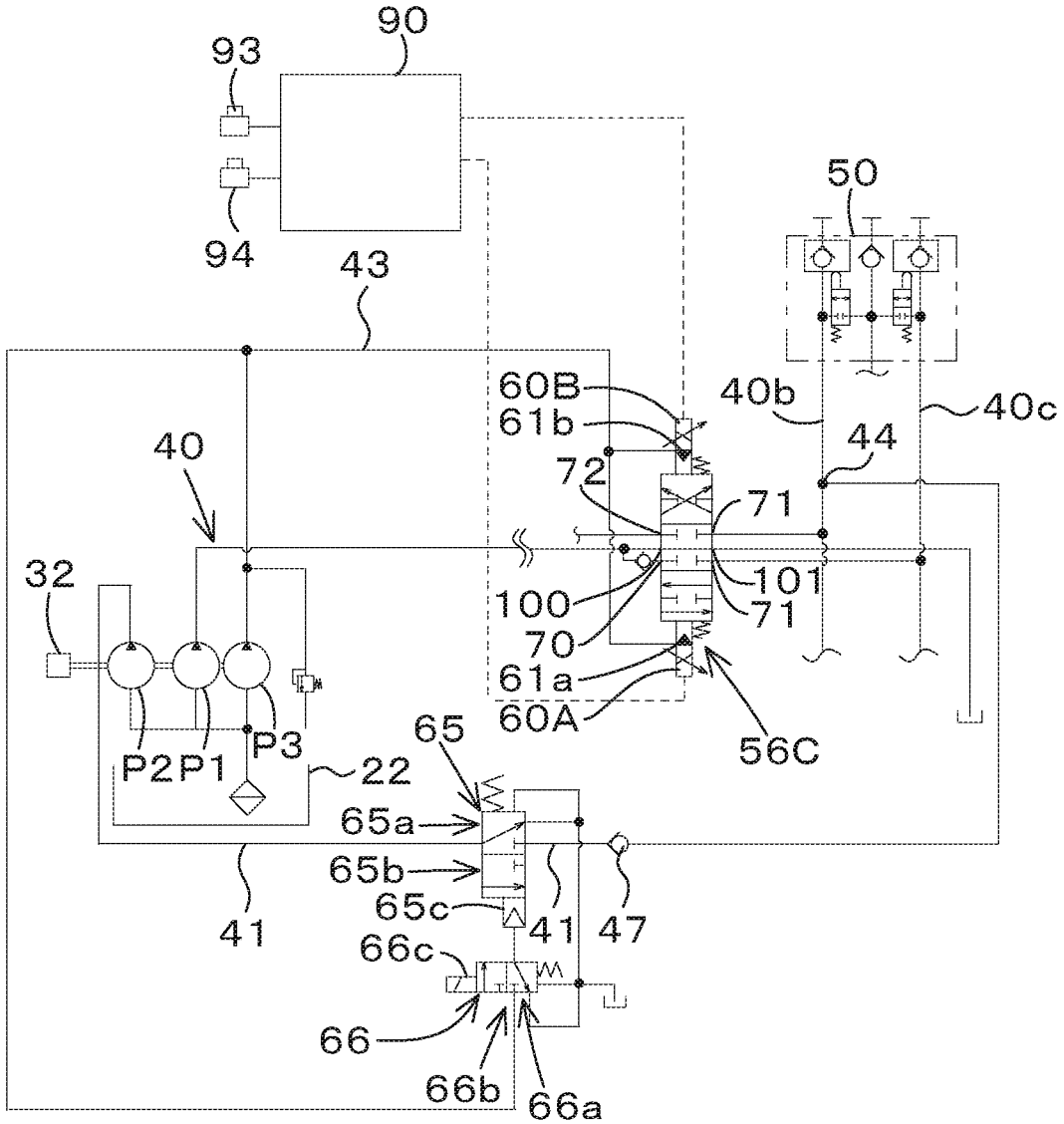
FIG. 4B is a modified example of the hydraulic system for the working machine according to the embodiment.

In addition, the pressure receiving portions 61*a* and 61*b* of the auxiliary control valve 56C are separately provided from the proportional valves (the first proportional valve 60A and the second proportional valve 60B). However, as shown in FIG. 4B, the pressure receiving portions 61*a* and 61*b* of the auxiliary control valve 56C and the proportional valves (the first proportional valve 60A and the second proportional valve 60B) may be integrally configured.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a first hydraulic pump to output a first operation fluid;

a second hydraulic pump to output a second operation fluid;

a hydraulic actuator;

a control valve including an input port connected to the first hydraulic pump, an output port connected to the hydraulic actuator, a first tank port, a second tank port and a first pressure-receiving portion, the control valve further including a spool configured to move in response to a pilot pressure on the first pressure-receiving portion, from a first supply position through a middle position to a first stop position, the first supply position preventing fluid communication between the input port and the first tank port and allowing fluid communication between the output port and the second tank port, the first stop position allowing fluid communication between the input port and the first tank port and preventing fluid communication between the output port and the second tank port, and the middle position allowing fluid communication between the input port and the first tank port and allowing fluid communication between the output port and the second tank port, a high flow valve connected to the second hydraulic pump and the hydraulic actuator, and configured to be switched between a second supply position allowing the second operation fluid to be supplied to the hydraulic actuator and a second stop position preventing the second operation fluid to be supplied to the hydraulic actuator; and a controller to control the high flow valve to be switched to the second supply position or the second stop position, wherein the controller controls the pilot pressure on the first pressure-receiving portion so that the spool moves gradually from the middle position to the first stop position at a when the high flow valve is in the second supply position, and the spool moves immediately from the first supply position to the first stop position when the high flow valve is in the second stop position.

2. The hydraulic system according to claim 1, further comprising:

a third hydraulic pump to output a third operation fluid;

a proportional valve connected to the third hydraulic pump and the first pressure-receiving portion of the control valve; and a switching valve connected to the third hydraulic pump and a second pressure-receiving portion of the high flow valve, wherein the controller uses the proportional valve to control the pilot pressure on the first pressure-receiving portion, and controls a switching pressure on the second pressure-receiving portion of the high flow valve to switch the high flow valve between the second supply position and the second stop position.

3. The hydraulic system according to claim 1, wherein each of the first hydraulic pump and the second hydraulic pump is a fixed displacement pump.

4. The hydraulic system according to claim 1, further comprising:

a switch electrically connected to the controller, wherein the controller controls in response to an operation of the switch, to switch the high flow valve between the second supply position and the second stop position.

5. The hydraulic system according to claim 1, further comprising:

an operation member electrically connected to the controller to input an operation amount, wherein the controller controls the second operation fluid supplied to the hydraulic actuator through the high flow valve in response to the operation amount input by the operation member.

6. A hydraulic system for a working machine, comprising:

a first hydraulic pump to output a first operation fluid;

a second hydraulic pump to output a second operation fluid;

a hydraulic actuator;

a control valve including an input port connected to the first hydraulic pump, an output port connected to the hydraulic actuator, a first tank port, a second tank port and a first pressure-receiving portion, the control valve further including a spool configured to move in response to a pilot pressure on the first pressure-receiving portion, from a first supply position through a middle position to a first stop position, the first supply position preventing fluid communication between the input port and the first tank port and allowing fluid communication between the output port and the second tank port, the first stop position allowing fluid communication between the input port and the first tank port and preventing fluid communication between the output port and the second tank port, and the middle position allowing fluid communication between the input port and the first tank port and allowing fluid communication between the output port and the second tank port, a high flow valve connected to the second hydraulic pump and the input port, and configured to be switched between a second supply position allowing the second operation fluid to be supplied to the input port and a second stop position preventing the second operation fluid to be supplied to the input port; and a controller to control the high flow valve to be switched to the second supply position or the second stop position, wherein the controller controls the pilot pressure on the first pressure-receiving portion so that the spool moves gradually from the middle position to the first stop position when the high flow valve is in the second supply position, and the spool moves immediately from the first supply position to the first stop position when the high flow valve is in the second stop position.

* * * * *